US007074077B2

(12) United States Patent
Sakaguchi et al.

(10) Patent No.: US 7,074,077 B2
(45) Date of Patent: Jul. 11, 2006

(54) CONNECTION CAP AND CABLE CONNECTION METHOD UTILIZING SAME

(75) Inventors: Tadahisa Sakaguchi, Shizuoka (JP); Masanori Onuma, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/999,979

(22) Filed: Dec. 1, 2004

(65) Prior Publication Data

US 2005/0164547 A1 Jul. 28, 2005

(30) Foreign Application Priority Data

Jan. 26, 2004 (JP) ..... 2004-016487

(51) Int. Cl.
*H01R 13/52* (2006.01)

(52) U.S. Cl. ..... 439/521; 174/76

(58) Field of Classification Search ..... 174/74 R, 174/74 A, 75 B, 76; 439/521
See application file for complete search history.

(56) References Cited

U.S. PATENT DOCUMENTS 3,550,765 A * 12/1970 Anderson ..... 174/138 F
6,359,226 B1 * 3/2002 Biddell et al. ..... 174/74 A
6,730,847 B1 * 5/2004 Fitzgerald et al. ..... 174/77 R
6,770,817 B1 * 8/2004 Kuwayama et al. ..... 174/84 C

FOREIGN PATENT DOCUMENTS

JP 10-243539 9/1998

* cited by examiner

*Primary Examiner*—Tho D. Ta
*Assistant Examiner*—Vanessa Girardi
(74) *Attorney, Agent, or Firm*—Armstrong, Kratz, Quintos, Hanson & Brooks, LLP

(57) ABSTRACT

A connection cap that includes a rear end wall positioned at a rear end of the connection cap for confining a sealing uncured resin, an opening positioned at a forward end of the connection cap for inserting a jointing portion of core wires of electrical cables, and a cylindrical wall extending from the opening to the rear end wall. The cylindrical wall has an inner surface formed with a plurality of ribs for positioning the jointing portion in the connection cap. The ribs are distributed in a circumferential direction to uniformly support the electrical cable. The uncured resin intrudes clearances each defined between adjacent two of the ribs. The inner surfaces of ribs define an inscribed circle having a diameter substantially the same as an outer diameter of a conductive sleeve for crimping the core wires. Advantageously, the ribs each have a forward end portion formed with a tapered surface gradually rising toward the rear end of connection cap.

4 Claims, 2 Drawing Sheets

CONNECTION CAP AND CABLE CONNECTION METHOD UTILIZING SAME

BACKGROUND OF THE INVENTION

1. Field of the Invention

The present invention relates to a connection cap and a cable connection method utilizing the same. The connection cap is used for connecting core wires of a plurality of sheathed cables to each other, so that the connection cap covers and holds a wire connection portion for insulation and waterproof protection of the connection portion.

2. Background Art

FIG. 5 shows a conventional one of such connection caps, for example disclosed in Japanese Patent Application Laid-open No. H. 10-243539.

In FIG. 5, a connection cap 50 can easily cover core portions 59*a* of jointed cables 59 without a troublesome work for surrounding the core portions 59*a* with an insulative resin material. The connection cap 50 has a cap main body 51 that receives the core portions 59*a*. The resin material, which is in an uncured state, is injected into the cap main body 51 to cover the core portions 59*a* and sheathes 59*b* of the jointed cables 59 so as to fill the cap.

The jointed cables 59 have ends of the sheathed cables, in which the sheathes 59*b* are stripped to provide an exposed core portion 59*a*. The core portion 59*a* has core wires electrically connected to each other. The core portion 59*a* is formed by crimping or welding before inserted into the cap main body 51. The cap main body 51 is made of an insulating synthetic resin material such as polyvinyl chloride, polyethylene, and polypropylene. The cap main body 51 has a rear end wall 52 at its distal end for closing the cap main body 51 and an opening 53 at its fore end for inserting the core portion 59*a*.

The cap main body 51 has a retainer plate 55 near the opening so as to extend opposite to the insertion direction of the jointed cables 59. The retainer plate 55 prevents disengagement of the jointed cables 59 from the connection cap 50. The jointed cables 59 are secured to the connection cap 50 with a tape 57 wound on the jointed cables 59 and the retainer plate 55.

The connection cap 50 has a sealing layer 56 defined by curing of a material such as an epoxy resin and a polyurethane resin, and the sealing layer 56 is electrically insulative and serves as a waterproof construction. The resin material has a viscosity with 100 to 5000 cps (0.1 to 5 Pa·s) when received between the cap main body 51 and the core portion 59*a*.

At an integrating step of the jointed cables 59 and the connection cap 50, an uncured resin is filled in the connection cap 50 before insertion of the jointed cables 59 into the connection cap 50. Thereby, the uncured resin intrudes between the core portion 59*a* and the cap main body 51 and between the sheathes 59*b* and the cap main body 51. The uncured resin also intrudes into clearances among wires of the core portion 59*a* by capillary effect. Then, the cap is kept at a temperature of 20 to 60° C. for 2 to 30 minutes, so that the resin is cured to secure the jointed cables 59 to the connection cap 50.

However, the conventional connection cap 50 involves a drawback described hereinafter.

The jointed cables 59 can not be correctly positioned in a radial direction (perpendicular to the insertion direction) within the connection cap 50 when inserted into the connection cap 50 with an uncured resin filled in the connection cap 50. This may cause a deviation of the core portion 59*a* from an axial center line of the cap main body 51. For example, when the resin cures with the core portion 59*a* contacting an inner surface of the cap, the resin intrudes insufficiently between the core portion 59*a* and the cap inner surface or in clearances among the wires. Accordingly, sealing of the core portion 59*a* is not surely achieved, decreasing quality and reliability of the connection cap 50.

Furthermore, the core portion 59*a* is defined by press-crimping, resistance welding, ultrasonic welding or the like. Such processes can not form the core portion 59*a* to have a circular section. It is disadvantageous that the connection cap 50 is formed to comply with the non-circular core portion 59*a*.

The connection cap 50 is unreliably positioned relative to the jointed cables 59 before the retainer plate 55 secures the cables with the tape 57. Even after securing by the tape 57, undesirable unwinding of the tape 57 causes that the jointed cables 59 deviate from their correct position within the cap.

SUMMARY OF THE INVENTION

In view of the aforementioned situation, an object of the invention is to provide a connection cap and a cable connection method utilizing the same. The connection cap achieves reliable sealing for jointing cables, and an undesirable movement of the cap relative to the jointing cables is prevented before a resin material hardens in the cap. The cap is easily manufactured with a reduced cost.

For achieving the object, a first aspect of the invention is a connection cap including:

a rear end wall positioned at a rear end of the connection cap for confining a sealing uncured resin, an opening positioned at a forward end of the connection cap for inserting a jointing portion of core wires of sheathed cables, and a cylindrical wall extending from the opening to the rear end wall.

The cylindrical wall has an inner surface formed with a plurality of ribs for positioning the jointing portion in the connection cap.

In thus configured cap, the jointing portion of the plurality of sheathed cables is inserted into the cap to be kept in the uncured resin filled in the cap. The uncured resin enters between the cylindrical wall and the wire cores and intrudes among element wires of the cores by capillary effect. The positioning ribs formed in the inner surface of the cylindrical wall contact the jointing portion in the cap to align the jointing portion with an axial center line of the cap. The uncured resin enters between adjacent two of the ribs, so that the uncured resin well distributes in a longitudinal direction of the cap. Thus, the uncured resin distributes uniformly around the jointing portion to improve sealing of the jointing portion. The uncured resin has a viscosity of 1 Pa·s, and the resin is an epoxy resin, a hot melt resin, a silicon resin, or the like, which is advantageous in insulating and waterproof ability.

Preferably, the ribs are extended parallel to an axial direction of the connection cap.

Thus, the positioning ribs provide an increased area contacting the jointing portion to restrict the movement of the jointing portion, so that the jointing portion is better positioned within the cap.

Preferably, the ribs each have a forward end portion formed with a tapered surface gradually rising toward the rear end of connection cap.

Thus, the jointing portion can be smoothly inserted into the cap from the opening, improving an assembling work for the cap and the jointing portion.

Preferably, the cylindrical wall has an inner surface formed with a shoulder abutting against an end of the jointing portion of the core wires to axially position the jointing portion in the connection cap.

Thus, the end of the jointing portion of the core wires abuts against the shoulder so that the jointing portion is axially correctly positioned within the cap. The core jointing portion also positions suitably relative to the positioning ribs.

Preferably, the cylindrical wall has a reduced inner diameter portion for receiving a leading end part of the jointing portion of the core wires.

This prevents a leading end of the wire cores from abutting against the rear end wall when the jointing portion is inserted into the cap. Thus, the connection cap improves the connection joint in reliability.

Preferably, the ribs define an inscribed circle having a diameter substantially the same as or slightly smaller than an outer diameter of the jointing portion.

When the ribs define such an inscribed circle, the jointing portion is provisionally correctly positioned in the cap with friction between the ribs and the jointing portion. This prevents the jointing portion from undesirably moving relative to the connection cap before hardening of the uncured resin. This provides a connection process more efficient than the conventional one described in the background art.

A second aspect of the invention is a cable connection method utilizing any one of the connection caps described above. The method includes the steps of:

defining the jointing portion by press-contacting the wire cores with a sleeve surrounding the wire cores by means of a rotary swaging unit, and inserting the jointing portion into the connection cap from the opening.

The method provides a core jointing portion having an outer diameter with a forming error of about ±0.02 mm, and the jointing portion may have a section of a generally circular shape. Electrical resistances among the element wires of the cable portion become uniform, improving electrical connection of the cable portion in reliability. Furthermore, the connection cap can be easily designed and constructed to comply with the jointing portion.

DETAILED DESCRIPTION OF THE PREFERRED EMBODIMENT

Referring to the accompanied drawings, an embodiment of the present invention will be discussed in detail hereinafter. FIGS. 1 to 4 show an embodiment of a connection cap and a cable connection method utilizing the connection cap according to the present invention.

A connection cap 10 is used for electrical connection of core wires of electrical cables 25 (sheathed cable) and for protecting a core portion 25*b* of the core wires in insulating and waterproof ability. For example, one of the electrical cables 25 is a lead from an electric circuit and the other is a cable connected to a battery. The electrical cable 25 may be a lead from a motor or an actuator like a solenoid. The electrical cable 25 also may be a branch line of a wiring harness or a lead from electric elements arranged in a junction box.

Each electrical cable 25 has an end stripped with respect to a sheath 25*a* to provide an exposed core portion 25*b* having a given length. The exposed length of the core portion 25*b* is a little shorter than an axial depth of the connection cap 10, so that the sheath 25*a* of the electrical cable 25 is retained near an opening 18 of the connection cap 10. The core portion 25*b* of the electrical cables 25 are longitudinally gathered in a bundle. The bundle is crimped with a sleeve (core jointing portion) 21 as illustrated in FIGS. 4A and 4B.

Figure 4A:
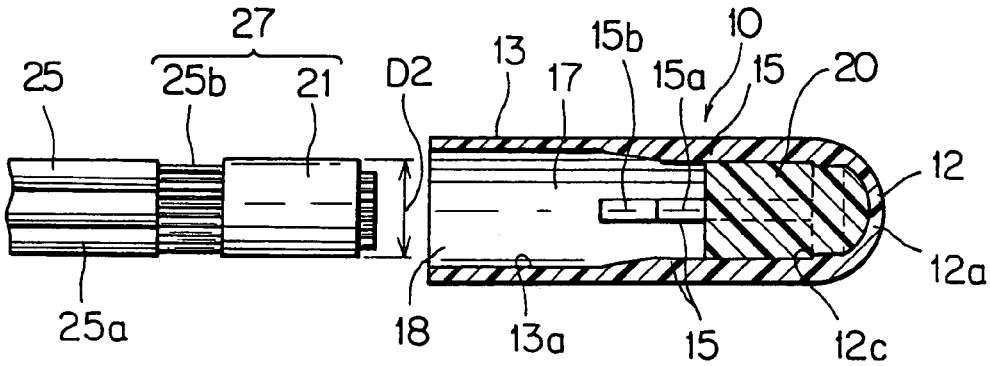
FIGS. 4A and 4B are sectional views showing sequentially a state before insertion of a jointing portion of electrical cables into the connection cap and a state after the insertion of the jointing portion into the cap.
Figure 4B:
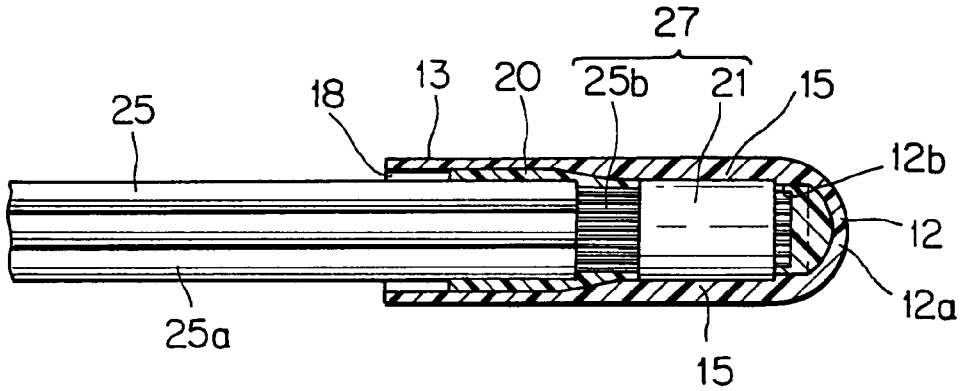
Figure 5:
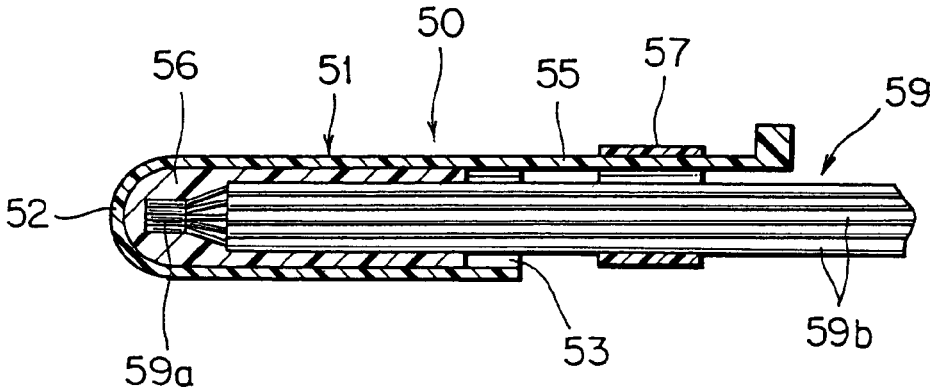
PRIOR ART FIG. 5
FIG. 5 is a longitudinal sectional view showing a conventional connection cap.

As shown in FIG. 4A, the core portions 25*b* and the conductive sleeve 21 compose a jointing portion 27 of the electrical cables 25. The conductive sleeve 21 is a pipe made of an electrically conductive metal such as copper and aluminum. A rotary swaging unit (not shown) defines the jointing portion 27 by uniformly compressing an outer circumferential surface of the conductive sleeve 21 with the core portion 25*b* therein. The swaging process helps the jointing portion 27 to have a generally circular section. Furthermore, the connection cap 10 is easily designed to comply with the jointing portion 27 having a circular section. Moreover, the swaging process can decrease contact resistance of the core portion 25*b*, improving the jointing portion 27 in connection reliability.

The rotary swaging unit conventionally has a spindle in which a die and a punch are movably retained. Briefly speaking about the swaging process, the spindle receives the conductive sleeve 21 with the core portion 25*b* therein so as to align with a rotary center line of the spindle. The die sandwiches the conductive sleeve 21, and the rotation of the spindle makes the punch cyclically press the die. Therefore, a circumferential outer surface of the conductive sleeve 21 is uniformly pressed.

The connection cap 10 of the embodiment can perform better in sealing and insulation and can prevent the cap from deviating relative to the jointing portion before hardening of an uncured resin 20. Furthermore, the connection cap 10 can be produced with a reduced cost. The connection cap includes: a rear end wall 12*a* positioned at a rear end of the connection cap for confining a sealing uncured resin 20, an opening 18 positioned at a fore end of the connection cap for inserting the jointing portion 27 of the core wires of the electrical cables 25, and a cylindrical wall 13 extending from the opening to the rear end wall. The cylindrical wall 13 has an inner surface formed with a plurality of ribs 15 for positioning the jointing portion 27 in the connection cap. The core portions 25*b* of the electrical cables 25 are jointed to define the jointing portion 27. The ribs 15 are distributed in a circumferential direction to uniformly support the electrical cables 25. The uncured resin 20 intrudes into clearances 16 each defined between adjacent two of the ribs 15. Inner surfaces 15*a* of ribs 15 define an inscribed circle having a diameter D1 substantially the same as or slightly smaller than an outer diameter D2 of the conductive sleeve 21. Advantageously, the ribs 15 each have a forward end portion formed with a tapered surface 15*b* gradually rising toward the rear end of connection cap 10.

Next, the connection cap 10 of the embodiment and a cable connection method utilizing the cap will be discussed in detail.

Figure 1:
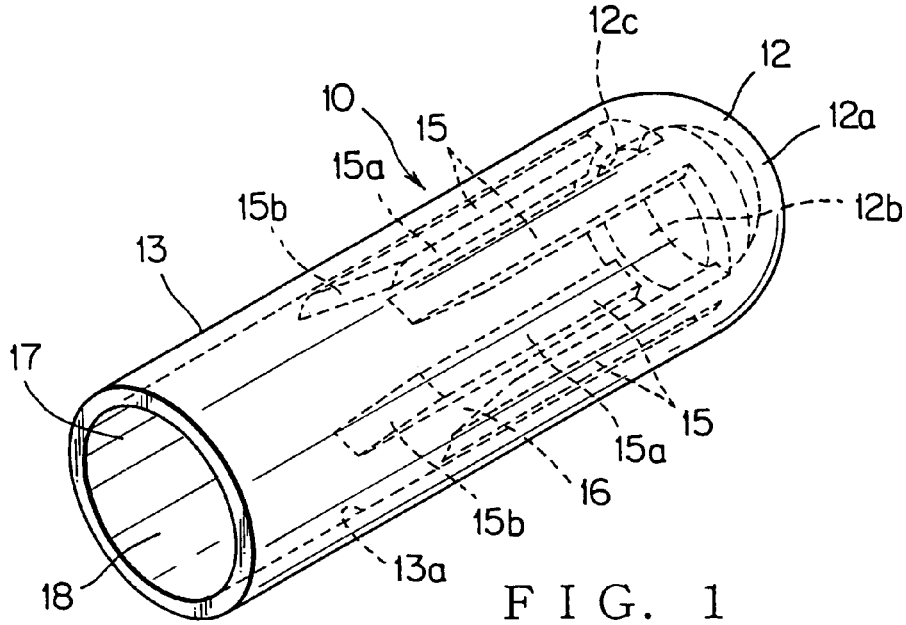
FIG. 1 is a perspective view showing an embodiment of a connection cap according to the present invention.

As shown in FIG. 1, the connection cap 10 is made of an insulating synthetic resin material such as polyvinyl chloride, polyethylene, polypropylene, or polyamide resin. The connection cap 10 is formed by injection molding. The connection cap 10 has a semi-spherical end wall 12*a* at its distal end for closing the connection cap 10 to confine an uncured resin 20. The uncured resin 20 may be a foamed urethane resin having a viscosity of about 1 Pa·s. The uncured resin 20 may be an epoxy resin, a hot melt resin, a silicon resin, or the like, which is advantageous in insulating and waterproof ability.

The open end of the connection cap 10 receives the jointing portion 27 crimped by the conductive sleeve 21. The uncured resin 20 covers the jointing portion 27 and end portions of the sheathes 25*a* within the connection cap 10. The uncured resin 20 also intrudes between the core portions 25*b* and the cylindrical wall 13, among the sheathes 25*a*, and among element wires of each core portion 25*b* by capillary effect, completing sealing of the jointing portion 27 from the outside.

The connection cap 10 has the rear end portion 12 and the circular cylinder body 13 to comply with the jointing portion 27. The cylinder body 13 defines a cable receiving space 17. If the jointing portion 27 is formed to have a non-circular section by utilizing ultrasonic welding or the like, it is disadvantageous that the connection cap 10 is formed to comply with the non-circular jointing portion 27 with more complicated dies. Therefore, the embodiment applies a rotary swaging process in which the conductive sleeve 21 crimps the jointing portion 27. The rotary swaging process helps the jointing portion 27 to have a circular section with a forming error of about ±0.02 mm. Thus, the connection cap 10 is easily formed with simpler dies, reducing a manufacturing cost of the connection cap 10. The jointing portion 27 also has a circular section, providing uniform electrical resistances among the element wires of the core portions 25*b* to improve electrical connection of the jointing portion 27 in reliability.

The cylindrical body 13 has an inner peripheral surface 13*a* formed with four positioning ribs 15 axially extended and symmetrically positioned relative to a central axis of the cylindrical body 13. The positioning rib 15 has a longitudinal length to correspond to the conductive sleeve 21 of the jointing portion 27 (FIG. 4B). The positioning rib 15 is extended in a distal side of the cylindrical body 13 by a half of the cylindrical body 13. The inner surfaces 15*a* of four ribs 15 define an inner cylindrical diameter D1 (FIG. 3) substantially the same as an outer diameter D2 (FIG. 4*a*) of the conductive sleeve 21.

Any number of the positioning ribs 15 may be provided. Preferably, there are arranged more than two positioning ribs 15 to align the jointing portion 27 with an axial center line of the connection cap 10. The positioning rib 15 has an axial length enough to stably retain the conductive sleeve 21 without looseness. Preferably, the axial length of the positioning rib 15 is the same as or a little longer than the conductive sleeve 21. Advantageously, the inner surfaces 15*a* of the positioning ribs 15 define an inscribed circle having the diameter D1 to align the conductive sleeve 21 with the cap center line and to provisionally secure the conductive sleeve 21. Therefore, the diameter D1 is determined to be substantially the same as or slightly smaller than an outer diameter D2 of the conductive sleeve 21.

Figure 3:
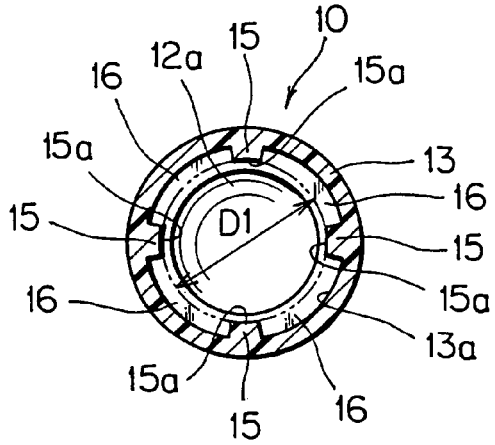
FIG. 3 is a cross sectional view showing the connection cap of FIG. 1.

Between adjacent two of the positioning ribs 15, the clearance 16 is defined to receive the uncured resin 20 (FIG. 3). The clearances 16 serve to distribute uniformly the uncured resin 20 within the connection cap 10, providing reliable sealing for the connection cap 10.

Figure 2:
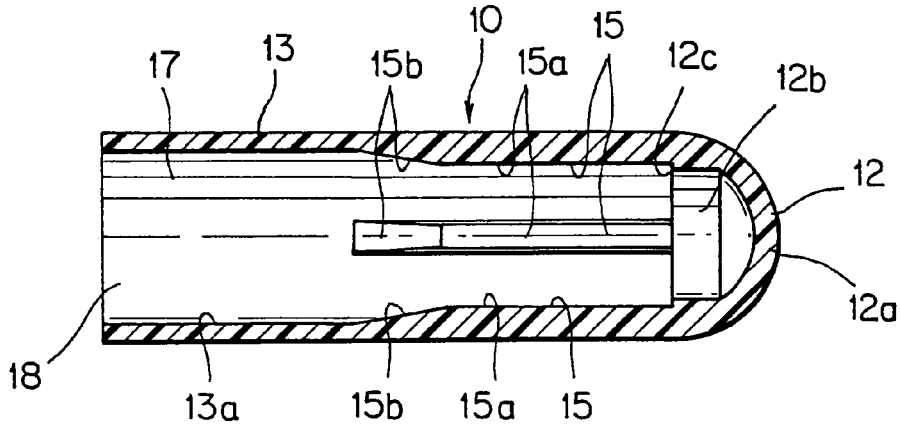
FIG. 2 is a longitudinal sectional view showing the connection cap of FIG. 1.

The ribs 15 each have a forward end portion formed with the tapered surface 15*b* gradually rising toward the rear end of connection cap 10 (FIGS. 1 and 2). Thus, the jointing portion 27 inserted into the connection cap 10 rides over the tapered surfaces 15*b* to move inward so that the jointing portion 27 is smoothly pushed into the connection cap 10 with a small force.

The connection cap 10 has an inner shoulder 12*c* and a reduced inner diameter portion 12*b* contiguous with the shoulder 12*c* (FIG. 4). The shoulder 12*c* abuts against a leading end of the conductive sleeve 21 to axially position the jointing portion 27. This prevents a forward end of the wire cores from abutting against the end wall 12*a* not to damage the end wall 12*a*. The reduced diameter portion 12*b* receives a leading end part of the jointing portion of the core wires. Thus, the connection cap improves the connection joint in reliability.

In the connection cap 10 of the embodiment, the positioning ribs 15 symmetrically formed in the inner surface 13*a* of the cylindrical wall 13 contact the jointing portion 27 in the cap 10 to align the jointing portion 27 with an axial center line of the cap 10. The uncured resin 20 enters between adjacent two of the ribs 15, so that the uncured resin 20 well distributes in a longitudinal direction of the cap 10. Thus, the uncured resin 20 distributes uniformly around the jointing portion 17 to improve sealing of the jointing portion 17. Furthermore, the positioning ribs 15 provisionally secure the jointing portion 27 in the cap 10 not to deviate axially and transversely.

The cable connection method utilizing the connection cap 10 of the embodiment applies the rotary swaging unit that compresses the conductive sleeve 21 so that the jointing portion 27 can have a section of a generally circular shape. Thus, the connection cap 10 can be easily designed and constructed to comply with the jointing portion 27.

The present invention is not limited in the embodiment described above but can be modified within the spirit of the invention.

What is claimed is:

1. A combination of a plurality of sheathed cables and a connection cap, wherein the cables have a jointing portion for their core wires, the jointing portion having an electrically conductive sleeve for crimping the core wires, the connection cap comprising:

a rear end wall positioned at a rear end of the connection cap for confining a sealing uncured resin, an opening positioned at a forward end of the connection cap for inserting the jointing portion, a cylindrical wall extending from the opening to the rear end wall, and a plurality of ribs circumferentially uniformly disposed in an inner surface of the cylindrical wall for positioning the sleeve in the connection cap, the ribs extended parallel to an axial direction of the connection cap with a clearance therebetween, the cylindrical wall having an inner surface formed with a shoulder abutting against an end of the sleeve to axially position the sleeve in the connection cap, wherein the ribs provide an inscribed circle having a diameter substantially the same as or slightly smaller than an outer diameter of the sleeve, and the clearance between the ribs permits the sealing uncured resin to pass therethrough, the resin fixing the sleeve with the connection cap after the resin is cured in the clearance.

2. The combination recited in claim 1 wherein the ribs each have a forward end portion formed with a tapered surface gradually rising toward the rear end of the connection cap.

3. The combination recited in claim 1 wherein the cylindrical wall has a reduced inner diameter portion for receiving a leading end part of the jointing portion of the core wires.

4. A cable connection method utilizing the combination recited in claim 1 comprising the steps of:

defining the jointing portion by press-contacting the wire cores with the sleeve surrounding the wire cores by means of a rotary swaging unit, and inserting the jointing portion into the connection cap from the opening.

* * * * *